US005467486A

United States Patent [19]

Guenther

[11] Patent Number: 5,467,486

[45] Date of Patent: Nov. 21, 1995

[54] FOLDABLE SHOWER/TUB SEAT

[75] Inventor: Torbett B. Guenther, 8992 Tamarack Ct., Plymouth, Mich. 48170

[73] Assignees: Torbett B. Guenther; Dolores Guenther, both of Plymouth, Mich.

[21] Appl. No.: 332,336

[22] Filed: Oct. 31, 1994

[51] Int. Cl.[6] ..... A47K 3/12

[52] U.S. Cl. ..... 4/578.1; 4/611; 297/14; 297/336; 108/42

[58] Field of Search ..... 4/496, 578.1, 579, 4/559, 611; 297/14, 336; 104/42, 47

[56] References Cited

U.S. PATENT DOCUMENTS

| | | | |
|---|---|---|---|
| 893,930 | 7/1908 | Lederman | 4/579 |
| 1,076,808 | 10/1913 | Arburg | 4/578.1 |
| 1,240,479 | 9/1917 | Nichols et al. | 4/578.1 |
| 1,880,621 | 10/1932 | Willetts | 108/42 |
| 2,131,214 | 9/1938 | Bentz | 4/579 X |
| 2,142,263 | 3/1939 | Bentz | 4/579 |
| 2,142,434 | 3/1939 | Bentz | 4/579 |
| 2,798,780 | 7/1957 | Motorney | 108/47 X |
| 4,233,911 | 11/1980 | Vignale | 108/47 X |
| 4,270,794 | 6/1981 | Lewis | 297/14 |
| 4,400,835 | 8/1983 | Richter | 4/578.1 |
| 4,909,158 | 3/1990 | Sorensen | 108/42 X |
| 5,185,892 | 2/1993 | Mitchell | 4/578.1 |

*Primary Examiner*—Robert M. Fetsuga

*Attorney, Agent, or Firm*—Barnes, Kisselle, Raisch, Choate, Whittemore & Hulbert

[57] ABSTRACT

A shower/tub seat that includes a pair of inverted U-shaped hangers adapted to be removably received over a horizontal bar affixed to a shower/tub wall so as to have inner hanger legs adjacent to the wall and outer hanger legs remote from the wall. A platform is pivotally mounted to the lower ends of the outer hanger legs so as to pivot between a vertical position adjacent to the outer hanger legs and a horizontal position for use. The platform has an end edge adjacent to the wall that engages the wall and the lower ends of the inner hanger legs in the horizontal position of the platform so as to hold the platform in horizontal position and support the weight of a person or objects placed on the platform. A pair of adjustable abutment feet are mounted on the lower ends of the inner hanger legs for adjusting horizontal orientation of the seat within the shower stall or over the bathtub.

15 Claims, 5 Drawing Sheets

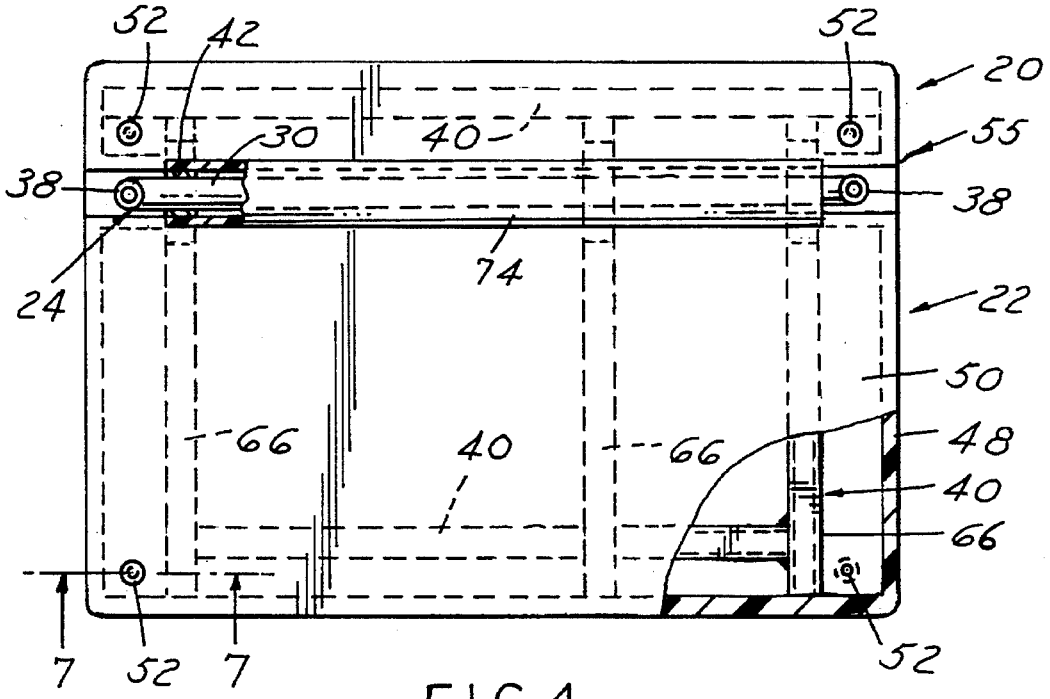
FIG.4
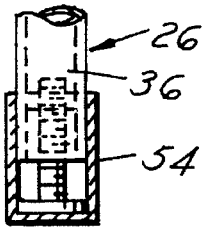
FIG.5
FIG.6
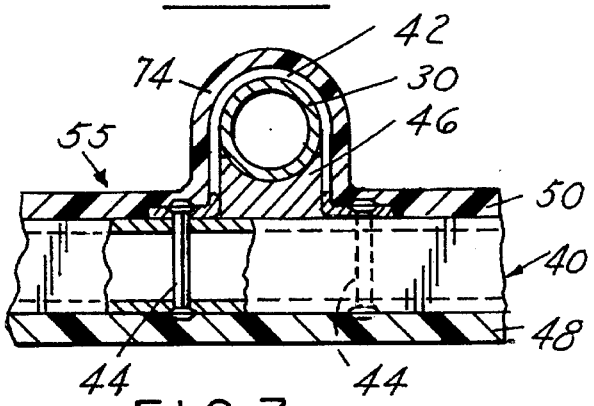
FIG.7
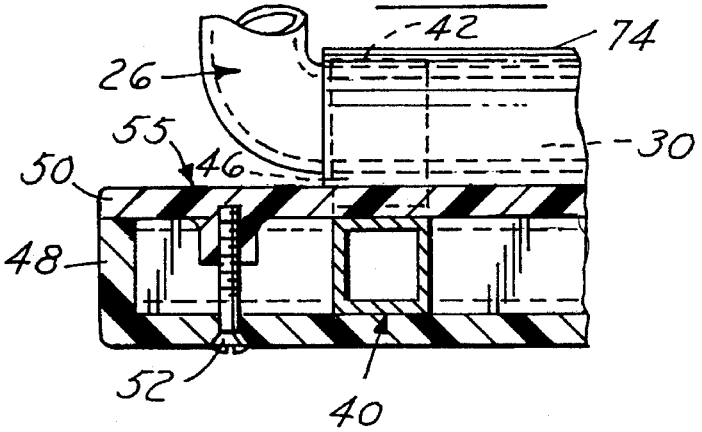

FOLDABLE SHOWER/TUB SEAT

The present invention is directed to a seat adapted to be mounted within a shower stall or above a bathroom tub, and having a seat platform that may be pivoted between a horizontal position for use and a vertical position for storage.

BACKGROUND AND SUMMARY OF THE INVENTION

Current shower/tub seats of the subject character are generally of a nature adapted to be permanently mounted to the wall within a shower stall or above a bathtub, and therefore are both difficult to mount and not amenable to removal for cleaning or storage. A general object of the present invention is to provide a shower/tub seat that is adapted to be removably suspended from a grab bar or the like within a shower stall or above a bathtub. Another and more specific object of the present invention is to provide a shower/tub seat of the described character that is economical to assembly, that may be readily mounted and demounted from within the shower stall or above the bathtub, and that may be marketed either alone or as a kit in combination with the grab bar.

A shower/tub seat in accordance with the present invention comprises a pair of inverted U-shaped hangers adapted to be removably received over a horizontal bar affixed to a shower/tub wall so as to have inner hanger legs adjacent to the wall and outer hanger legs remote from the wall. A platform is pivotally mounted to the lower ends of the outer hanger legs so as to pivot between a vertical position in abutment with the outer hanger legs and a horizontal position for use. The platform has an end edge adjacent to the wall that engages the wall and the lower ends of the inner hanger legs in the horizontal position of the platform so as to hold the platform in horizontal position and support the weight of a person or objects placed on the platform. Preferably, a pair of adjustable abutment feet are mounted on the lower ends of the inner hanger legs for adjusting horizontal orientation of the seat within the shower stall or over the bathtub.

In one embodiment of the invention, the platform is constructed of welded metal tube stock and a water repellant cover of molded plastic composition. The platform frame has facility for accepting an extension, so that the basic frame may be employed for constructing a platform of generally rectangular geometry without the extension, or an L-shaped platform with the extension. The inverted U-shaped hangers are of round tube stock, and are integrally joined to each other by a length of tube stock that extends between the hangers. A hinge is affixed to the platform frame and pivotally embraces the length of tube stock that extends between the hangers. The seat may be marketed alone, either in rectangular or L-shaped configuration as described, or may be marketed as a kit with a grab bar to be affixed to the shower or tub wall for suspending the seat.

In a second embodiment of the invention, the platform frame comprises lengths of generally rectangular tube stock having brackets for affixing each length to the lower ends of the outer hanger legs. A nylon bearing encompasses the end of each outer hanger leg, and the associated bracket is affixed to the hanger leg externally of the bearing by threaded elements that pivotally mount the bracket and associated frame tube segment to the hanger leg while functioning as a friction brake so as to help hold the platform in the raised position. A seat of molded plastic construction joins the frame tube sections to each other so as to form a seat assembly pivotally mounted to the hanger legs as described above.

BRIEF DESCRIPTION OF THE DRAWINGS

The invention, together with additional objects, features and advantages thereof, will be best understood from the following description, the appended claims and the accompanying drawings in which:

FIG. 4 is a sectional view taken substantially along the line 4—4 in FIG. 1;

FIG. 5 is a fragmentary sectional view taken substantially along the line 5—5 in FIG. 3;

FIG. 6 is a fragmentary sectional view taken substantially along the line 6—6 in FIG. 1;

FIG. 7 is a fragmentary sectional view taken substantially along the line 7—7 in FIG. 4;

DETAILED DESCRIPTION OF PREFERRED EMBODIMENTS

Figure 2:
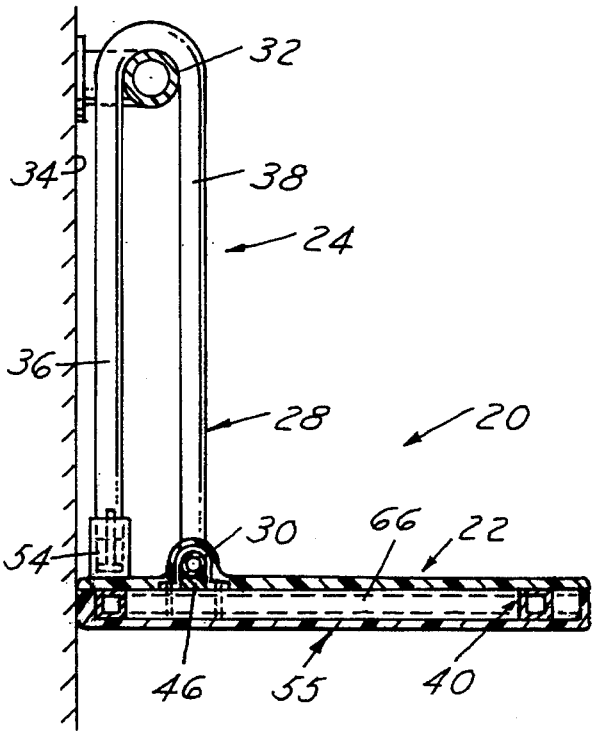
FIG. 2 is a sectional view taken substantially along the line 2—2 in FIG. 1.

FIGS. 1–7 illustrate a shower/tub seat 20 in accordance with one embodiment of the invention as comprising a seat platform 22 pivotally mounted at the lower end of a hanger 24. (It will be appreciated that directional adjectives such as "upper," "lower," "inner" and "outer" refer to the preferred orientation of the seat during use, as will be described). Hanger 24 comprises a pair of spaced and aligned inverted U-shaped leg members 26,28 of round tube stock integrally and monolithically joined to each other by a horizontal length of tube stock 30. Hanger 24 with seat platform 22 attached is adapted to be removably received over and suspended from a hollow tubular grab bar 32 affixed to the wall 34 of a shower stall or above a bathtub. When so suspended from grab bar 32, hanger leg members 26,28 have inner legs or reaches 36 positioned adjacent to wall 34, and outer legs or reaches 38 spaced from wall 34. Horizontal tube stock length 30 joins the lower ends of outer legs 38, and platform 22 is pivotally mounted to length 30, as will be described.

Figure 3:
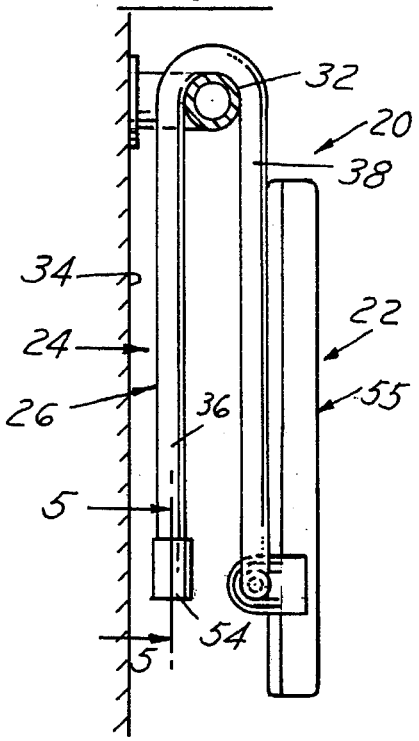
FIG. 3 is a view similar to that of FIG. 2 but showing the seat platform in the raised position.
Figure 1:
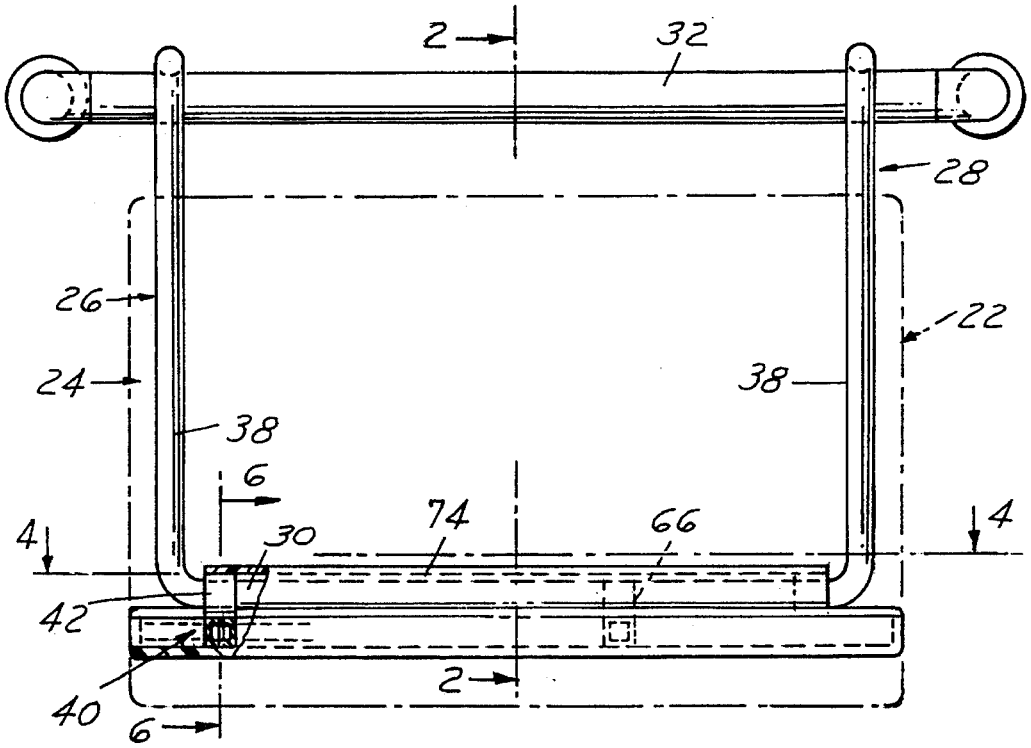
FIG. 1 is a side elevational view of a shower/tub seat in accordance with one embodiment of the invention.

Seat platform 22 comprises a rigid rectangular frame 40 of welded metal tube stock. A plurality of inverted U-shaped brackets 42 are fastened by rivets 44 in spaced alignment along frame 40 so as pivotally to capture hanger length 30 together with a concave section of friction material 46. A cup-shaped base 48 and a cover 50 are fastened to each other by a plurality screws 52 so as to enclose frame 40 and form a seat platform cover 55 of water repellant construction such as molded plastic. Seat platform 22 is thus pivotally suspended from hanger 24 by means of brackets 42 effectively forming a platform hinge, so as to pivotable between a vertical orientation adjacent to outer hanger legs 38 as illustrated in FIG. 3, and a horizontal position illustrated in FIG. 2 for use as a seat. In such horizontal position as illustrated in FIG. 2, the inner edge of seat platform 22 not only engages and rests against the adjacent wall 34, but also abutingly engages the lower ends of inner legs 36. The weight of the seat and anything supported by the seat is thus absorbed by wall 34 and grab bar 32. Preferably, a cup-shaped foot 54 is adjustably and threadably fastened to the lower end of each inner leg 36 for adjusting horizontal orientation of platform 22 in the position of FIG. 2. It will also be noted in FIG. 2 that a reach of frame 40 is disposed within seat platform 22 immediately beneath to feet 54, so that the load placed on platform on 22 is supported by the platform frame and not by a portion of cover 55.

Figure 8:
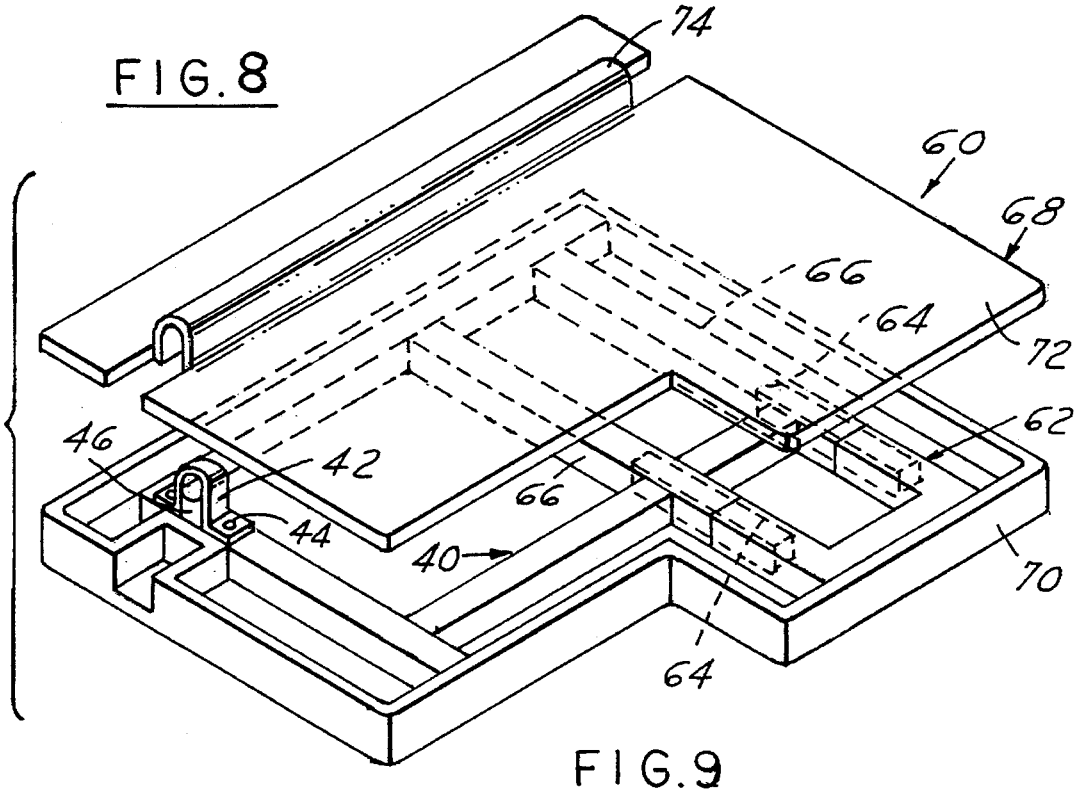
FIG. 8 is an exploded perspective view that illustrates a modified seat in accordance with the present invention.
Figure 9:
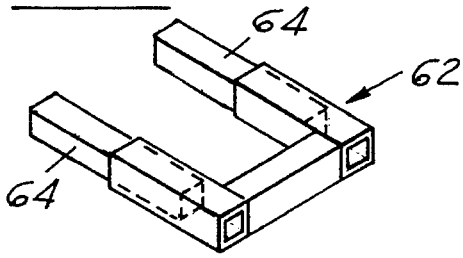
FIG. 9 is a perspective view of the platform frame extension employed in constructing the seat of FIG. 8.
Figure 10:
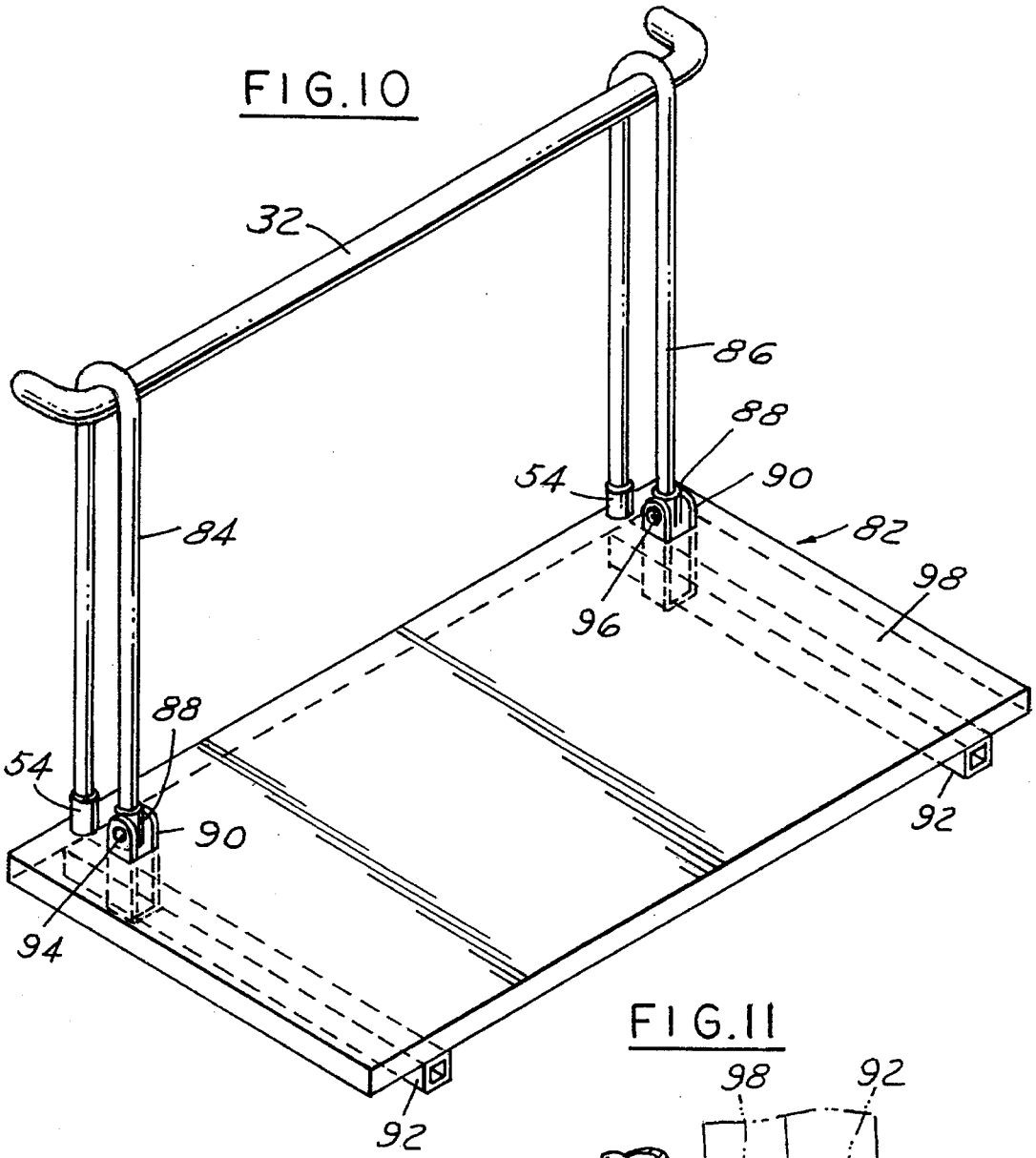
FIG. 10 is a perspective view of a shower/tub seat in accordance with a presently preferred second embodiment of the present invention.
Figure 11:
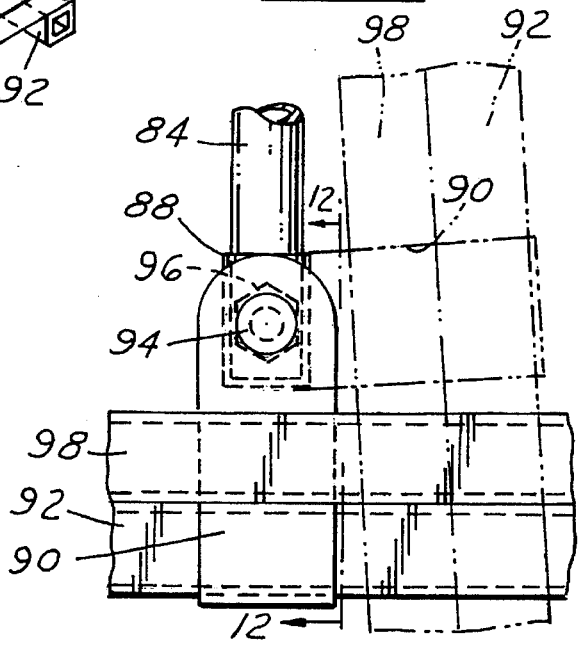
FIG. 11 is a fragmentary elevational view of the platform hinge arrangement in the embodiment of FIG. 10.

Government regulations in some applications require an L-shaped seat. One feature of the present invention lies in the fact that the basic generally rectangular frame 40 illustrated in FIGS. 1–7 is constructed so as to accept an extension 62, as shown in FIGS. 8–10, for constructing such an L-shaped seat, so that the basic platform frame 40 as well as the basic hanger 24 can be employed in all of the seat assemblies, with only the frame extension and modified seat covers being required. This greatly reduces inventory expenses associated with providing two such seat configurations. More specifically, in the modified shower/tub seat 60 illustrated in FIGS. 8–10, a U-shaped frame extension 62 has a pair of legs 64 that are slidably received within the open tube stock ends of two parallel reaches 66 of the basic frame 40. A modified cover 68, comprising a base 70 and a lid 72 of molded plastic construction, encloses frame 40 modified by extension 62. As in the embodiment of FIGS. 1–7, lid 72 includes a section 74 that encloses the horizontal reach 30 of hanger 24, as well as the hinges formed by brackets 42 and friction pads 46. The friction pads cooperate with the cover lid so as to seal the interior of the platform from ingress of water.

Figure 12:
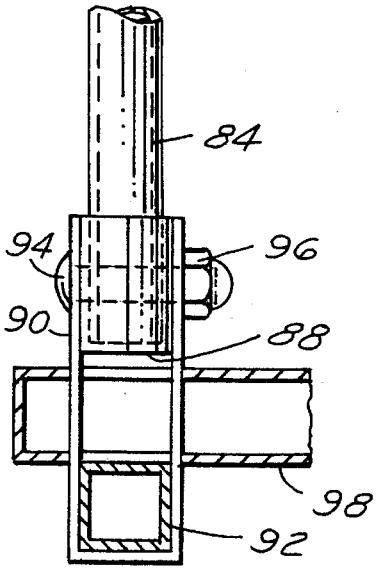
FIG. 12 is a fragmentary sectional view taken substantially along the line 12—12 in FIG. 11.
Figure 14:
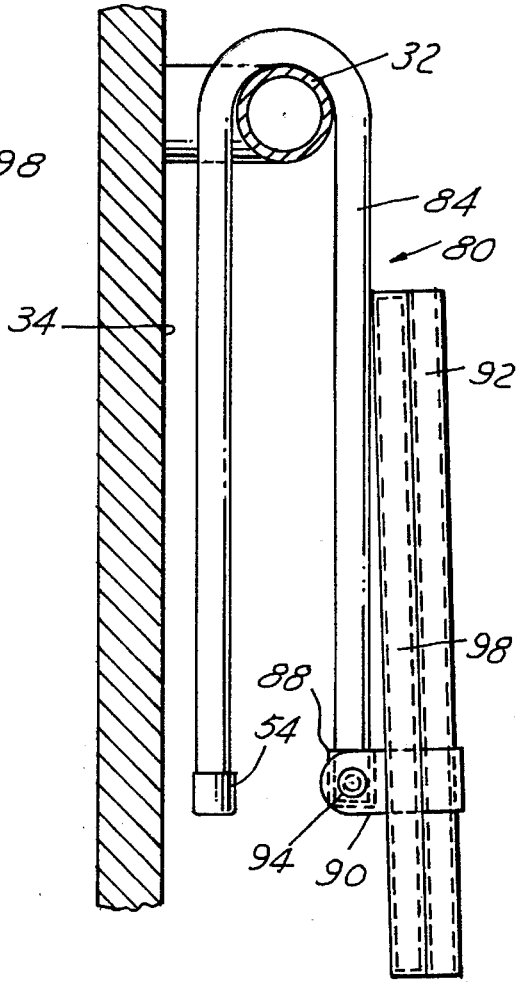
FIG. 14 is a side elevational view similar to that of FIG. 13 but showing the seat in the raised position.
Figure 13:
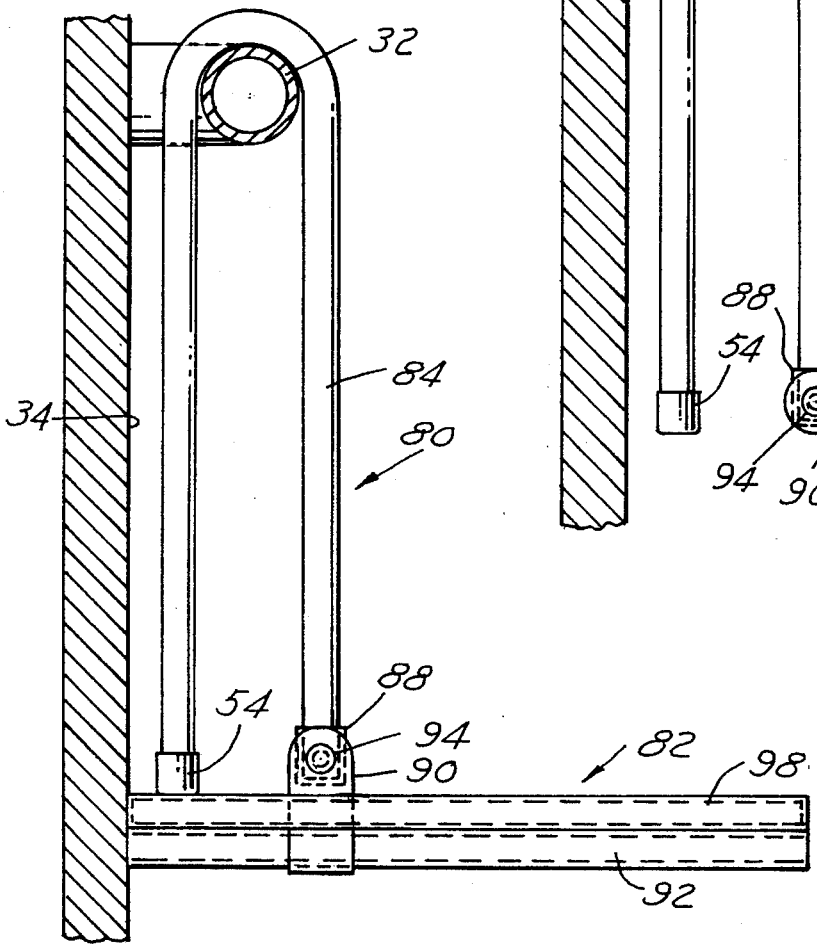
FIG. 13 is a side elevational view of the shower/tub seat illustrated in FIG. 10.

FIGS. 10–14 illustrate a shower/tub seat 80 in accordance with a presently preferred second embodiment of the invention as comprising a seat platform 82 pivotally mounted to the lower ends of a pair of U-shaped hangers 84,86. A cup-shaped foot 54 is adjustably and threadably fastened to the lower ends of the inner legs of hangers 84,86 as previously described. The lower ends of the outer hanger legs carry cylindrical bearing elements 88. Seat platform 82 comprises a pair of U-shaped brackets 90, each of which embraces a length 92 of rectangular tube stock of stainless steel composition, for example. The free ends of brackets 90 are affixed to the free ends of the outer legs of hangers 84,86 by a bolt 94 and a lock nut 96 (FIG. 12). The lock nuts 96 are tightened sufficiently to clamp bracket 90 against bearing sleeves 88, and thereby form a friction brake to help hold platform 82 in the upper position illustrated in FIG. 14. Frame lengths 92 are fastened to each other by an overlying seat 98, which may be of hollow mold-formed plastic composition for example.

I claim:

1. A shower/tub seat for mounting to a horizontal bar affixed to a shower/tub wall, the shower/tub seat comprising:

U-shaped hanger means adapted to be removably received over the horizontal bar so as to have an inner leg adjacent to the wall and an outer leg remote from the wall, and a platform including means mounting said platform to a lower end of said outer leg so as to pivot between a vertical position adjacent to said outer leg and a horizontal position, said platform having an end edge portion adapted to engage the wall and simultaneously engage a lower end of said inner leg in said horizontal position of said platform to support weight placed on said platform.

2. The seat set forth in claim 1 further comprising abutment means adjustably mounted on said lower end of said inner leg for adjusting angular position of said platform upon engagement with said inner leg.

3. The seat set forth in claim 1 wherein said hanger means comprises spaced inverted U-shaped hangers each having an inner and outer leg, said platform being pivotally mounted to said outer legs and extending therebetween.

4. The seat set forth in claim 3 wherein said platform comprises a frame of tubular metal construction and a seat of water repellant construction affixed to said frame.

5. The seat set forth in claim 4 wherein said seat is of molded plastic construction.

6. The seat set forth in claim 5 wherein said frame is of generally rectangular outline and has means for affixing an extension to said frame such that said frame is adapted for constructing a rectangular platform without said extension and an L-shaped platform with said extension.

7. The seat set forth in claim 3 further comprising a pair of feet mounted on said lower ends of said inner legs with means for adjusting angular position of said platform upon engagement with said feet.

8. The seat set forth in claim 7 wherein said adjustment means comprises means threadably mounting said feet to said lower ends of said inner legs.

9. The seat set forth in claim 3 wherein said means mounting said platform to said hanger means comprises a length of round metal tube stock affixed to and extending between said spaced hangers, and hinge means on said platform pivotally mounting said platform to said length of tube stock.

10. The seat set forth in claim 9 wherein said hanger means is constructed of round tube stock of one-piece monolithic construction with said length of tube stock.

11. The seat set forth in claim 10 wherein said platform comprises a frame of metal tube stock and a water-repellant cover, and wherein said hinge means is affixed to said frame.

12. The seat set forth in claim 3 wherein said means mounting said platform to said hanger means comprises brake means for holding said platform in said vertical position.

13. The seat set forth in claim 12 wherein said brake means comprises a friction brake.

14. The seat set forth in claim 13 wherein said friction brake comprises threaded fastener pivotally mounting said platform to lower ends of said outer leg.

15. The seat set forth in claim 1 further comprising a grab bar adapted to be affixed to the tub/shower wall packaged as a kit with said hanger means and said platform.

* * * * *